United States Patent [19]

Fujimura et al.

[11] Patent Number: 4,773,950

[45] **Date of Patent: * Sep. 27, 1988**

[54] PERMANENT MAGNET

[75] Inventors: Setsuo Fujimura, Kyoto; Masato Sagawa, Nagaokakyo; Yutaka Matsuura, Ibaraki; Hitoshi Yamamoto; Norio Togawa, both of Osaka, all of Japan

[73] Assignee: Sumitomo Special Metals Co., Ltd., Osaka, Japan

[ * ] Notice: The portion of the term of this patent subsequent to Jul. 22, 2003 has been disclaimed.

[21] Appl. No.: 532,473

[22] Filed: Sep. 15, 1983

[30] Foreign Application Priority Data

Aug. 2, 1983 [JP] Japan ..... 58-140590

[51] Int. Cl.[4] ..... H01F 1/04

[52] U.S. Cl. ..... 148/302; 420/83; 420/121; 75/244; 75/245; 75/246

[58] Field of Search ..... 148/31.57, 442, 403, 148/302; 420/416, 435, 581, 455, 583, 587, 83, 121; 75/123 A, 123 B, 123 E, 123 H, 123 J, 123 K, 123 L, 123 M, 123 N, 124 A, 124 B, 124 C, 124 E, 124 F, 125, 126 G, 128 E, 128 F, 126 H, 126 P, 244–246

[56] References Cited

U.S. PATENT DOCUMENTS

| | | | |
|---|---|---|---|
| 2,167,240 | 7/1939 | Hensel | 148/104 |
| 3,560,200 | 2/1971 | Nesbitt et al. | 75/122 |
| 3,684,593 | 8/1972 | Benz et al. | 148/102 |
| 4,063,970 | 12/1977 | Steingroever | 148/103 |
| 4,401,482 | 8/1983 | Green et al. | 419/29 |
| 4,533,408 | 8/1985 | Koon | 148/103 |

FOREIGN PATENT DOCUMENTS

| | | |
|---|---|---|
| 0046075 | 2/1982 | European Pat. Off. . |
| 0106948 | 5/1984 | European Pat. Off. . |
| 0126179 | 11/1984 | European Pat. Off. . |
| 55-115304 | 9/1980 | Japan . |
| 55-132004 | 10/1980 | Japan . |
| 56-65954 | 6/1981 | Japan . |
| 58-123853 | 7/1983 | Japan . |
| 734597 | 8/1955 | United Kingdom . |

OTHER PUBLICATIONS

Givord, "Crystal Chemical and Magnetic Properties of the $R_2Fe_{14}B$ Family of Compounds, Pre-Print, pp. 131–142, Oct. 1984.

Lee, Appl. Phys. Lett., 46, vol. 8, Apr. 15, 1985, "Hot--Pressed Neodymium-Iron-Boron Magnets", pp. 790–791.

Chapter 15, "Handbook on the Physics and Chemistry of Rare Earths", vol. 2, Magnetostrictive $RFe_2$ Intermetallic Compounds, p. 231.

Greedan et al., Jour. of Solid State Chemistry, 6, 1975, "An Analysis of the Rare Earth Contribution to the Magnetic . . . ", pp. 387–395.

Lee, J. Appl. Phys., vol. 52, Mar. 1981, "The Future of Rare Earth-Transition Metal Magnets of Type $RE_2TM_{17}$", pp. 2549–2553.

Ohashi, "Effects of Praseodymium Substitution of Precipitation Hardened Rare Earth Magnets", pp. 493–501, Jun. 1981.

Chapter 14, "Handbook of the Physics and Chemistry of Rare Earths", vol. 2, 1979, Magnetic Properties of Intermetallic Compounds . . . , pp. 55–56, 155–161.

Neumann et al., "Line Start Motors Designed with Nd-Fe-B Permanent Magnets", pp. 77–89, May 1985.

(List continued on next page.)

*Primary Examiner*—John P. Sheehan

*Attorney, Agent, or Firm*—Burns, Doane, Swecker & Mathis

[57] ABSTRACT

A magnetically anisotropic sintered permanent magnet of the FeBR system in which R is sum of $R_1$ and $R_2$ wherein:

$R_1$ is Dy, Tb, Gd, Ho, Er, Tm and/or Yb, and $R_2$ comprises 80 at % or more of Nd and Pr in $R_2$ and the balance of at least one of other rare earth elements exclusive of $R_1$, said system comprising by atomic percent, 0.05 to 5% of $R_1$, 12.5 to 20% of R, 4 to 20% of B, and the balance being Fe with impurities. Additional elements M(Ti, Zr, Hf, Cr, Mn, Ni, Ta, Ge, Sn, Sb, Bi, Mo, Nb, Al, V, W,) may be present.

26 Claims, 5 Drawing Sheets

OTHER PUBLICATIONS

J. J. Croat, "Permanent Magnet Properties of Rapidly Quenched Rare Earth-Iron Alloys", IEEE Trans. Mag., vol. MAG-18, No. 6, Nov., 1982, pp. 1442-1447.
R. K. Mirshra, "Microstructure of Melt-Spun Neodymium-Iron-Boron Magnets", International Conference on Magnetism, 1985.
Hadjipanayis et al., Final Technical Report: 0001AE, "Investigation of Crystalline Iron-Platinum Nickel and Amorphous Rare Earth . . . ", Mar. 15, 1983.
Koo, IEEE Transactions on Magnetics, vol. MAG-20, No. 5, Sep., 1984, "Partial Substitution of SM with Neodymium, Praseodymium, . . . ".
Burzo, "Some New Results in the Field of Magnetism of Rare-Earth Compounds", pp. 1-17, and drawings, Mar. 1985.
Ormerod, "Processing and Physical Metallurgy of NdFeB and Other R.E. Magnets", Pre-Print, pp. 69-92, Oct. 1984.
IEEE Trans. on Magnetics., vol. MAG-18, No. 6, Nov. 1982, pp. 1448-1450, Koon et al., "Composition Dependence of the Coercive . . . ".
IEEE Trans. on Magetics, vol. MAG-20, No. 5, part 2, Sep., 1984, pp. 1584-1589, Sagawa et al., "Permanent Magnet Materials . . . ".
Hadjipanaysis et al., "Electronic and Magnetic Properties of Rare-Earth-Transition-Metal Glasses", Sep. 27, 1979, pp. 101-107.
Croat, "Magnetic Hardening of Pr-Fe and Nd-Fe Alloys by Melt Spinning", J. Appl. Phys., Apr. 4, 1982, pp. 3161-3169.
"Powder Metallurgy—Applied Products (II)—Magnetic Materials", 1964.
Chikazumi et al., "Magnetic Body Handbook", 1975.
"Hard Magnetic Material", vol. 3, Magnetic Engineering Seminar, edited by Ida et al.
Kaneko et al., "Magnetic Materials", Nov. 1977.
"Magnetic Materials of Modern Age", edited by Mito-Kato-Gijutsu Kyokai, Jun. 5, 1981.

B-H demagnetization curves at 20°c and 100°c of the R-Co magnet

1. Fe-8B-15Nd (Table 2, No.*1)
2. Fe-7B-12.5Nd-1.5Dy-1Nd (Table 3, No. 20)
3. Fe-8B-12Nd-3Dy (Table 2, No.8)

B-H demagnetization curves at 20°c and 100°c of Fe-8B-13.5Nd-1.5Dy magnet

PERMANENT MAGNET

FIELD OF THE INVENTION AND BACKGROUND

The present invention relates to high-performance permanent magnet materials based on rare earth elements and iron, which make no use of Co that is rare and expensive.

Magnetic materials and permanent magnets are one of the important electric and electronic materials applied in an extensive range from various electrical appliances for domestic use to peripheral terminal devices of large-scaled computers. In view of recent needs for miniaturization and high efficiency of electric and electronic equipment, there has been an increasing demand for upgrading of permanent magnets and in general magnetic materials.

Now, referring to the permanent magnets, typical permanent magnet materials currently in use are alnico, hard ferrite and rare earth-cobalt magnets. With a recent unstable supply of cobalt, there has been a decreasing demand for alnico magnets containing 20–30 wt % of cobalt. Instead, inexpensive hard ferrite containing iron oxides as the main component has showed up as major magnet materials. Rare earth-cobalt magnets are very expensive, since they contain 50–65 wt % of cobalt and make use of Sm that is not much found in rare earth ores. However, such magnets have often been used primarily for miniaturized magnetic circuits of high added value, because they are by much superior to other magnets in magnetic properties.

In order to make it possible to inexpensively and abundantly use high-performance magnets such as rare earth-cobalt magnets in wider fields, it is required that one does not substantially rely upon expensive cobalt, and uses mainly as rare earth metals light rare earth elements such as neodymium and praseodymium which occur abundantly in ores.

In an effort to obtain permanent magnets as an alternative to such rare earth-cobalt magnets, studies have first been made of binary compounds based on rare earth elements and iron.

Existing compounds based on rare earth elements and iron are limited in number and kind compared with the compounds based on rare earth elements and cobalt, and are generally low in Curie temperature (point). For that reason, any attempts have resulted in failure to obtain magnets from the compounds based on rare earth elements and iron by casting or powder metallurgical technique used for the preparation of magnets from the compounds based on rare earth elements and cobalt.

A. E. Clark discovered that sputtered amorphous $TbFe_2$ had a coercive force, Hc, of as high as 30 kOe at 4.2° K., and showed Hc of 3.4 kOe and a maximum energy product, (BH)max, of 7 MGOe at room temperature upon heat-treating at 300° to 350° C. (Appl. Phys. Lett. 23(11), 1973, 642–645).

J. J. Croat et al have reported that Hc of 7.5 kOe is obtained with the melt-quenched ribbons of NdFe and PrFe wherein light rare earth elements Nd and Pr are used. However, such ribbons show Br of 5 kG or below and (BH)max of barely 3–4 MGOe (Appl. Phys. Lett. 37, 1980, 1096; J. Appl. Phys. 53, (3) 1982, 2404–2406).

Thus, two manners, one for heat-treating the previously prepared amorphous mass and the other for melt-quenching it, have been known as the most promising means for the preparation of magnets based on rare earth elements and iron.

However, the materials obtained by these methods are in the form of thin films or strips so that they cannot be used as the magnet materials for ordinary electric circuits such as loud speakers or motors.

Furthermore, N. C. Koon et al discovered that Hc of 9 kOe was reached upon heat treated (Br=5 kG) with melt-quenched ribbons of heavy rare earth element-containing FeB base alloys to which La was added, say, $(Fe_{0.82}B_{0.81})_{0.9}Tb_{0.05}La_{0.05}$ (Appl. Phys. Lett. 39(10), 1981, 840–842).

In view of the fact that certain FeB base alloys are made easily amorphous, L. Kabacoff et al prepared the melt-quenched ribbons of $(Fe_{0.8}B_{0.2})_{1-x}Pr_x$ (x=0–0.3 in atomic ratio), but they showed Hc of only several Oe at room temperature (J. Appl. Phys. 53(3) 1982, 2255–2257).

The magnets obtained from such sputtered amorphous thin film or melt-quenched ribbons are thin and suffer limitations in view of size, and do not provide practical permanent magnets which can be used as such for general magnetic circuits. In other words, it is impossible to obtain bulk permanent magnets of any desired shape and size such as the prior are ferrite and rare earth-cobalt magnets. Since both the sputtered thin films and the melt-quenched ribbons are magnetically isotropic by nature, it is indeed almost impossible to obtain therefore magnetically anisotropic permanent magnets of high performance.

Recently, the permanent magnets have increasingly been exposed to even severer circumstances—strong demagnetizing fields incidental to the thinning tendencies of magnets, strong inverted magnetic fields applied through coils or other magnets, high processing rates of current equipment, and high temperatures incidental to high loading—and, in many applications, now need possess a much higher coercive force for the stabilization of their properties. It is generally noted in this connection that the iHc of permanent magnets decreases with increases in temperature. For that reason, they will be demagnetized upon exposure to high temperatures, if their iHc is low at room temperature. However, if iHc is sufficiently high at room temperature, such demagnetization will then not substantially occur.

Ferrite or rare earth-cobalt magnets make use of additive elements or varied composition systems to obtain a high coercive force; however, there are generally drops of saturation magnetization and (BH)max.

SUMMARY OF THE DISCLOSURE

An essential object of the present invention is to provide novel permanent magnets and magnet materials, from which the disadvantages of the prior art are substantially eliminated.

As a result of studies made of a number of systems for the purpose of preparing compound magnets based on R-Fe binary systems, which have a high Curie point and are stable at room temperature, it has already been found that FeBR and FeBRM base compounds are especially suited for the formation of magnets (U.S. patent application Ser. No. 510,234 filed on July 1, 1983).

A symbol R is here understood to indicate at least one of rare earth elements inclusive of Y and, preferably, refer to light rare earth elements such as Nd and Pr. B denotes boron, and M stands for at least one element selected from the group consisting of Al, Ti, V, Cr, Mn, Zr, Hf, Nb, Ta, Mo, Ge, Sb, Sn, Bi, Ni and W.

The FeBR magnets have a practically sufficient Curie point of as high as 300° C. or more. In addition, these magnets can be prepared by the powder metallurgical procedures that are alike applied to ferrite or rare earth-cobalt systems, but not successfully employed for R-Fe binary systems.

The FeBR base magnets can mainly use as R relatively abundant light rare earth elements such as Nd and Pr, do not necessarily contain expensive Co or Sm, and can show (BH)max of as high as 36 MGOe or more that exceeds largely the highest (BH)max value (31 MGOe) of the prior art rare earth-cobalt magnets.

It has further been found that the magnets based on these FeBR and FeBRM system compounds exhibit crystalline X-ray diffraction patterns that are sharply distinguished over those of the conventional amorphous strips or melt-quenched ribbons, and contain as the major phase a novel crystalline structure of the tetragonal system (U.S. patent application Ser. No. 510,234 now abandoned).

In general, these FeBR and FeBRM base alloys have a Curie point ranging from about 300° C. to 370° C.

More specifically, the present invention has for its object to increase the thermal properties, particularly iHc while retaining a maximum energy product, (BH)max, which is identical with, or larger than, that obtained with the aforesaid FeBR and FeBRM base magnets.

According to the present invention, it is possible to markedly increase the iHc of FeBR and FeBRM base magnets wherein as R light rare earth elements such as Nd and Pr are mainly used, while maintaining the (BH)max thereof at a high level, by incorporating thereto $R_1$ forming part of R, said $R_1$ representing at least one of rare earth elements selected from the group consisting of Dy, Tb, Gd, Ho, Er, Tm and Yb. Namely, $R_1$ is mainly comprised of heavy rare earth elements.

That is to say, the permanent magnets according to the present invention are as follows.

Magnetically anisotropic sintered permanent magnets are comprised of the FeBR system in which R represents the sum of $R_1$ and $R_2$ wherein:

$R_1$ is at least one of rare earth elements selected from the group consisting of Dy, Tb, Gd, Ho, Er, Tm and Yb, and $R_2$ includes a total of 80 at % or more of Nd and Pr relative to the entire $R_2$, and contains at least one of other rare earth elements exclusive of $R_1$ but inclusive of Y, said system consisting essentially of, by atomic percent, 0.05 to 5% of $R_1$, 12.5 to 20% of R, 4 to 20% of B, and the balance being Fe with impurities.

The other aspect of the present invention provides an anisotropic sintered permanent magnet of the FeBRM system.

DETAILED DESCRIPTION OF THE PREFERRED EMBODIMENTS

Figure 1:
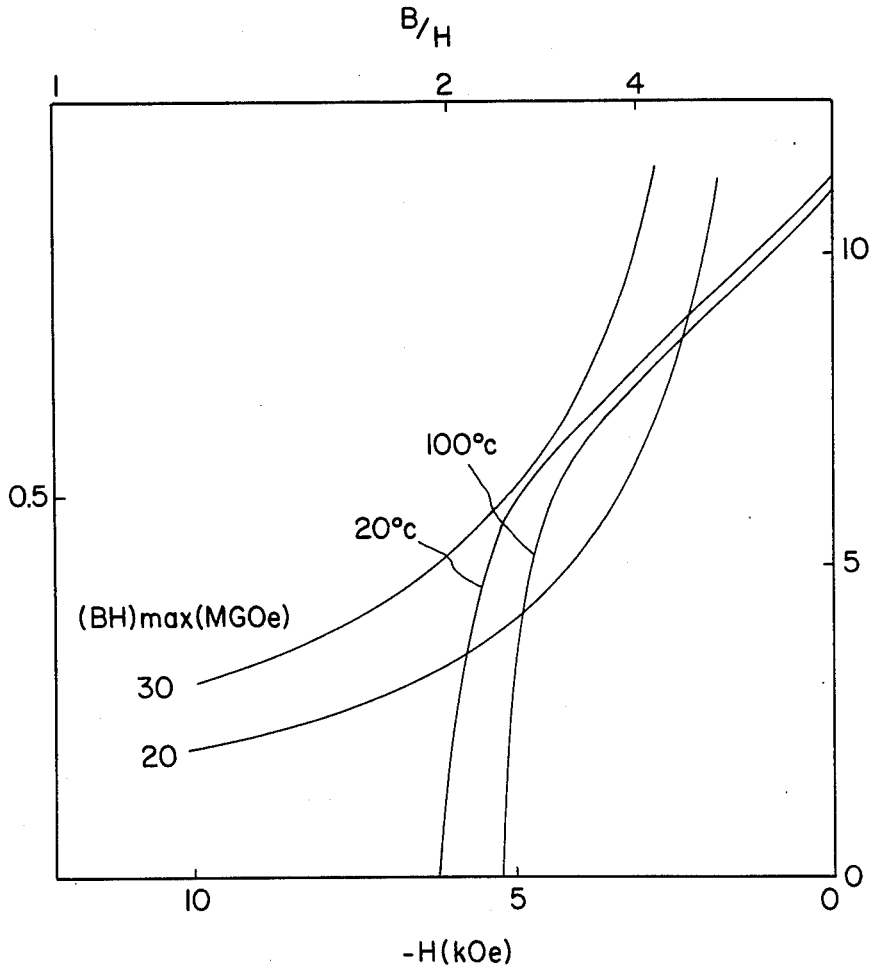
FIG. 1 is a graph showing the B-H demagnetization curves at 20° C. and 100° C. of the R-Co magnet with the permeance coefficient B/H.

In the present disclosure, % denotes atomic percent if not otherwise specified.

Magnetically anisotropic sintered permanent magnets comprise FeBRM systems in which R represents the sum of $R_1$ and $R_2$, and M represents one or more additional elements to be added in amounts of no more than the values as specified below wherein:

$R_1$ is at least one of rare earth elements selected from the group consisting of Dy, Tb, Gd, Ho, Er, Tm and Yb, $R_2$ includes a total of 80% or more of Nd and Pr and contains at least one of light rare earth elements exclusive of $R_1$ but inclusive of Y, and M is

| | | |
|---|---|---|
| 3% Ti, | 3.3% Zr, | 3.3% Hf, |
| 4.5% Cr, | 5% Mn, | 6% Ni, |
| 7% Ta, | 3.5% Ge, | 1.5% Sn, |
| I % Sb, | 5% Bi, | 5.2% Mo, |
| 9% Nb, | 5% Al, | 5.5% V, |
| and 5% W, | | |

said systems essentially consisting of, by atomic percent, 0.05 to 5% of $R_1$, 12.5 to 20% of R, 4 to 20% of B and the balance being Fe with impurities, provided that, when two or more additional elements M are included, the sum of M should be no more than the maximum value among those specified above of said elements M actually added.

It is noted that the allowable limits of typical impurities to be included in the end products should be no higher than the following values by atomic percent:

| | | |
|---|---|---|
| 2% Cu, | 2% C, | 2% P, |
| 4% Ca, | 4% Mg, | 2% O, |
| 5% Si, and 2% S. | | |

It is noted, however, that the sum of impurities should be no more than 5%.

Such impurities are expected to be originally present in the starting material, or to come from the process of production, and the inclusion thereof in amounts exceeding the aforesaid limits would result in deterioration of properties. Among these impurities, Si serves both to increase Curie points and to improve corrosion resistance, but incurs decreases in iHc in an amount exceeding 5%. Ca and Mg may abundantly be contained in the R raw material, and has an effect upon increases in iHc. However, it is unpreferable to use Ca and Mg in larger amounts, since they deteriorate the corrosion resistance of the end products.

Having the composition as mentioned above, the permanent magnets show a coercive force, iHc, of as high as 10 kOe or more, while they retain a maximum energy product, (BH)max, of 20 MGOe or more.

The present invention will now be explained in detail.

As mentioned above, the FeBR base magnets possess high (BH)max, but their iHc was only similar to that of the $Sm_2Co_{17}$ type magnet which was typical one of the conventional high-performance magnets (5 to 10 kOe). This proves that the FeBR magnets are easily demagnetized upon exposure to strong demagnetizing fields or high temperatures. The iHc of magnets generally decreases with increases in temperature. For instance, the $Sm_2Co_{17}$ type magnets or the FeBR base magnets have a coercive force of barely 5 kOe at 100° C. (see Table 4).

Any magnets having such iHc cannot be used for magnetic disc actuators for computers or automobile motors, since they tend to be exposed to strong demagnetizing fields or high temperatures. To obtain even higher stability at elevated temperatures, it is required to further increase iHc at temperatures near room temperature.

It is generally known that magnets having higher iHc are more stable even at temperatures near room temperature against deterioration with the lapse of time (changes with time) and physical disturbances such as impacting and contacting.

Based on the above-mentioned knowledge, further detailed studies were mainly focused on the FeBR componental systems. As a result, it has been found that a combination of at least one of rare earth elements Dy, Tb, Gd, Ho, Er, Tm and Yb with light rare earth elements such as Nd and Pr can provide a high coercive force that cannot possibly be obtained with the FeBR and FeBRM base magnets.

Furthermore, the compositional systems according to the present invention have an effect upon not only increases in iHc but also improvements in the loop squareness of demagnetization curves, i.e., further increases in (BH)max. Various studies made to increase the iHc of the FeBR base magnets have revealed that the following procedures are effective.

(1) Increasing the amount of R or B, and (2) adding additional element(s) M.

However, it is recognized that increasing the amount of R or B serves to enhance iHc, but, as that amount increases, Br decreases with the values of (BH)max decreasing as a result.

It is also true that the additional element(s) M is effective to increase iHc, but, as the amount of M increases, (BH)max drops again, thus not giving rise to any noticeable improvements.

In accordance with the permanent magnets of the present invention, an increase in iHc by aging is remarkable owing to the inclusion of $R_1$ that is rare earth elements, especially heavy rare earth elements, the main use of Nd and Pr as $R_2$, and the specific composition of R and B. It is thus possible to increase iHc without having an adverse influence upon the value of Br by aging the magnetically anisotropic sintered bodies comprising alloys having the specific composition as mentioned above. Besides, the loop squareness of demagnetization curves is improved, while (BH)max is maintained at the same or higher level. It is noted in this connection that, when the composition of R and B and the amount of Nd plus Pr are within the specified ranges, iHc of about 10 kOe or higher is already reached prior to aging. Post-aging thus gives rise to a more favorable effect in combination with the incorporation of a given amount of $R_1$ into R.

That is to say, the present invention provides high-performance magnets which, while retaining (BH)max of 20 MGOe or higher, with sufficient stability to be expressed in terms of iHc of 10 kOe or higher, and can find use in applications wider that those in which the conventional high-performance magnets have found use.

The maximum values of (BH)max and iHc are 38.4 MGOe (see No. 19 in Table 3 given later) and 20 kOe or more (see No. 8 in Table 2 and Nos. 14, 22 and 23 in Table 3), respectively. (It is here noted that the reason why the value of iHc is shown as 20 kOe or more is that measuring could not be performed with a demagnetization tester of the ordinary electromagnet type).

In the permanent magnets according to the present invention, R represents the sum of $R_1$ and $R_2$, and encompasses Y as well as rare earth elements Nd, Pr, La, Ce, Tb, Dy, Ho, Er, Eu, Sm, Gd, Pm, Tm, Yb and Lu. Out of these rare earth elements, at least one of seven elements Dy, Tb, Gd, Ho, Er, Tm and Yb is used as $R_1$. $R_2$ represents rare earth elements except the above-mentioned seven elements and, especially, includes a sum of 80 at % or more of Nd and Pr in the entire $R_2$, Nd and Pr being light rare earth elements.

The rare earth elements used as R may or may not be pure, and those containing impurities entrained inevitably in the process of production (other rare earth elements, Ca, Mg, Fe, Ti, C, O, S and so on) may be used alike, as long as one has commercially access thereto. Also alloys of those rare earth elements with other componental elements such as Nd-Fe alloy, Pr-Fe alloy, Dy-Fe alloy or the like may be used.

As boron (B), pure- or ferro-boron may be used, including those containing as impurities Al, Si, C and so on.

When composed of 0.05–5 at % $R_1$, 12.5–20 at % R representing the sum of $R_1+R_2$, 4–20 at % B, and the balance being Fe, the permanent magnets according to the present invention show a high coercive force (iHc) on the order of no less than about 10 kOe, a high maximum energy product ((BH)max) on the order of no less than 20 MGOe and a residual magnetic flux density (Br) on the order of no less than 9 kG.

The composition of 0.2–3 at % $R_1$, 13–19 at % R, 5–11 at % B, and the balance being Fe are preferable in that they show (BH)max of 30 MGOe or more.

As $R_1$ particular preference is given to Dy and Tb.

The reason for placing the lower limit of R upon 12.5 at % is that, when the amount of R is below that limit, Fe precipitates from the alloy compounds based on the present systems, and causes a sharp drop of coercive force. The reason for placing the upper limit of R upon 20 at % is that, although a coercive force of no less than 10 kOe is obtained even in an amount exceeding 20 at %, yet Br drops to such a degree that the required (BH)max of no less than 20 MGOe is not attained.

Referring now to the amount of $R_1$ forming part of R, Hc increases even by the substitution of 0.1% $R_1$ for a part of R, as will be understood from No. 2 in Table 2. The loop squareness of demagnetization curves is also improved with increases in (BH)max. The lower limit of $R_1$ is placed upon 0.05 at %, taking into account the effects upon increases in both iHc and (BH)max (see FIG. 2). As the amount of $R_1$ increases, iHc increases (Nos. 2 to 8 in Table 2), and (BH)max decreases bit by bit after showing a peak at 0.4 at %. However, for example, even 3 at % addition gives (BH)max of 30 MGOe or higher (see FIG. 2).

In applications for which stability is especially needed, the higher the iHc, say, the more the amount of $R_1$, the better the results will be. However, the elements constituting $R_1$ are contained in rare earth ores to only a slight extent, and are very expensive. This is the reason why the upper limit of $R_1$ is fixed at 5 at %. When the amount of B is 4 at % or less, iHc decreases to 10 kOe or less. Like R, B serves to increase iHc, as its amount increases, but there is a drop of Br. To give (BH)max of 20 MGOe or more the amount of B should be no more than 20 at %.

The additional element(s) M serves to increase iHc and improve the loop squareness of demagnetization curves. However, as the amount of M increases, Br deceases. Br of 9 kG or more is thus needed to obtain (BH)max of 20 MGOe or more. This is the reason why the upper limits of M to be added are fixed as mentioned in the foregoing. When two or more additional elements M are included, the sum of M should be no more than the maximum value among those specified in the foregoing of said elements M actually added. For instance, when Ti, Ni and Nb are added, the sum of these elements is no more than 9 at %, the upper limit of Nb. Preferable as M are V, Nb, Ta, Mo, W, Cr and Al. It is noted that, except some M such as Sb or Sn, the amount of M is preferably within about 2 at %.

The permanent magnets of the present invention are obtained as sintered bodies. It is then important that the sintered bodies have a mean crystal grain size of 1 to 80 microns, for the FeBR systems and 1 to 90 microns for the FeBRM system. For both systems, the mean crystal grain size preferably amounts to 2–40 microns and more preferably about 3–10 microns. Sintering may be carried out at a temperature of 900° to 1200° C. Aging following sintering can be carried out at a temperature between 350° C. and the sintering temperature, preferably between 450° and 800° C. The alloy powders for sintering have appropriately a mean particle size of 0.3 to 80 microns, preferably 1 to 40 microns, more preferably 2–20 microns. Sintering conditions, etc. are disclosed in a parallel U.S. application to be assigned to the same assignee with this application based on Japanese Patent Application Nos. 58-88373 and 58-90039.

The embodiments and effects of the present invention will now be explained with reference to examples, which are given for the purpose of illustration alone, and are not intended to limit the scope of the present invention.

Samples were prepared by the following steps (purity is given by weight).

(1) Alloys were melted by high-frequency melting and cast in a water-cooled copper mold. As the starting materials for Fe, B and R use was made of 99.9% electrolytic iron, ferroboron alloys of 19.38% B, 5.32% Al, 0.74% Si, 0.03% C and the balance Fe, and a rare earth element or elements having a purity of 99.7% or higher with the impurities being mainly other rare earth elements, respectively.

(2) Pulverization: The castings were coarsely ground in a stamp mill until they passed through a −35-mesh sieve, and then finely pulverized in a ball mill for 3 hours to 3–10 microns.

(3) The resultant powders were aligned in a magnetic field of 10 kOe and compacted under a pressure of 1.5 $t/cm^2$.

(4) The resultant compacts were sintered at 1000°–1200° C. for one hour in an argon atmosphere and, thereafter, allowed to cool.

The samples were processed, polished, and tested to determine their magnetic properties in accordance with the procedures for measuring the magnetic properties of electromagnets.

EXAMPLE 1

Prepared were alloys containing as R a number of combinations of Nd with other rare earth elements, from which magnets were obtained by the above-mentioned steps. The results are shown in Table 1. It has been found that, among the rare earth elements R, there are certain elements $R_1$ such as Gd, Ho, Er, Yb and so on, which have a marked effect on improvements in iHc, as seen from Nos. 6 to 9. Nos. *1 to *5 show comparison examples.

EXAMPLE 2

In accordance with the foregoing procedures, magnets were obtained using light rare earth elements, mainly Nd and Pr, in combination with the rare earth elements, which were chosen in a wider selection than as mentioned in Example 1 and applied in considerably varied amounts. To increase further iHc, heat treatment was applied at 600° to 700° C. for two hours in an argon atmosphere. The results are set forth in Table 2.

In table 2, No. *1 is a comparison example wherein only Nd was used as the rare earth element. Nos. 2 to 8 are examples wherein Dy was replaced for Nd. iHc increases gradually with increases in the amount of Dy, and (BH)max reaches a maximum value when the amount of Dy is about 0.4 at %. See also FIG. 2.

Figure 2:
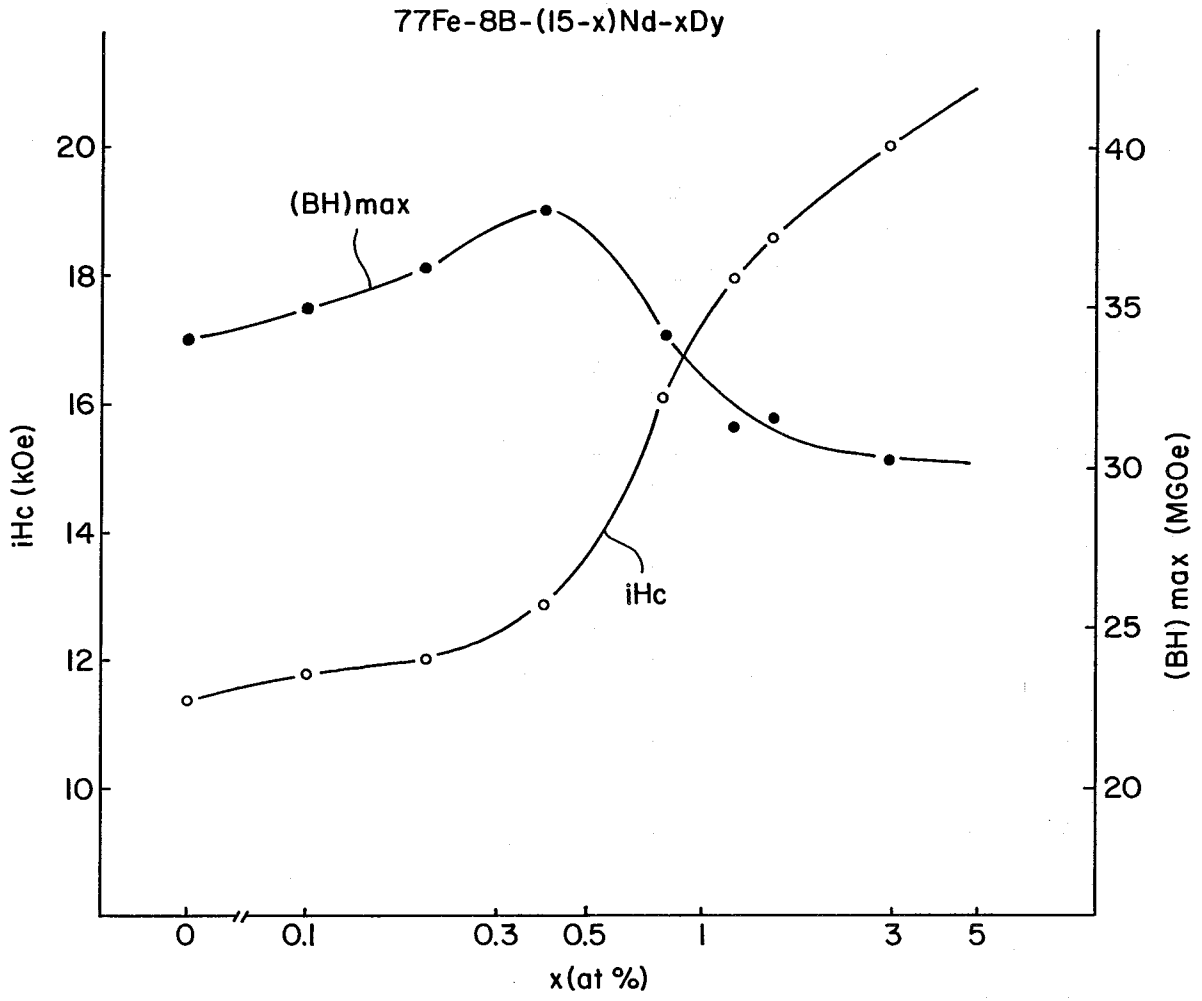
FIG. 2 is a graph showing changes in iHc (kOe) and (BH)max (MGOe) of one embodiment of the present invention wherein Dy is replaced for Nd (the abscissa-logarithmic scale, x—at % Dy)

FIG. 2 (with the abscissa expressed in the term of a log scale) indicates that Dy begins to affect iHc from 0.05 at %, and enhance its effect from 0.1 to 0.3 at %. Although Gd(No. 10), Ho(No. 9), Tb(No. 11), Er(No. 12), Yb(No. 13), etc. have a similar effect, yet a particularly large effect on increases in iHc is obtained with Dy and Tb. The elements represented by $R_1$, other than Dy and Tb, also give iHc exceeding largely 10 kOe and high (BH)max. Any magnets materials having (BH)max of as high as 30 MGOe or higher which can provide such a high iHc have not been found until now.

Figure 3:
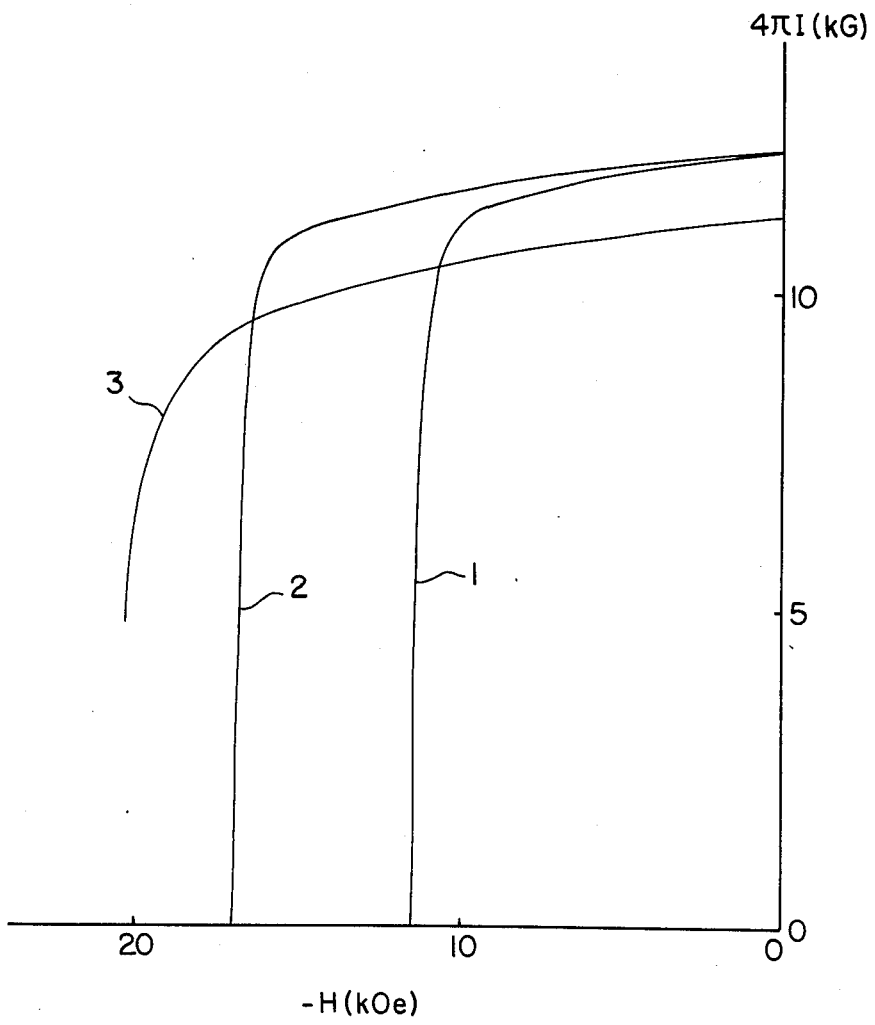
FIG. 3 is a graph showing the demagnetization curves of the magnets according to the present invention.

FIG. 3 shows a demagnetization curve of 3% Dy (No. 8 in Table 2) having typical iHc, from which it is recognized that iHc is sufficiently high compared with that of the Fe-B-Nd base sample (No. *1 in Table 2).

Figure 4:
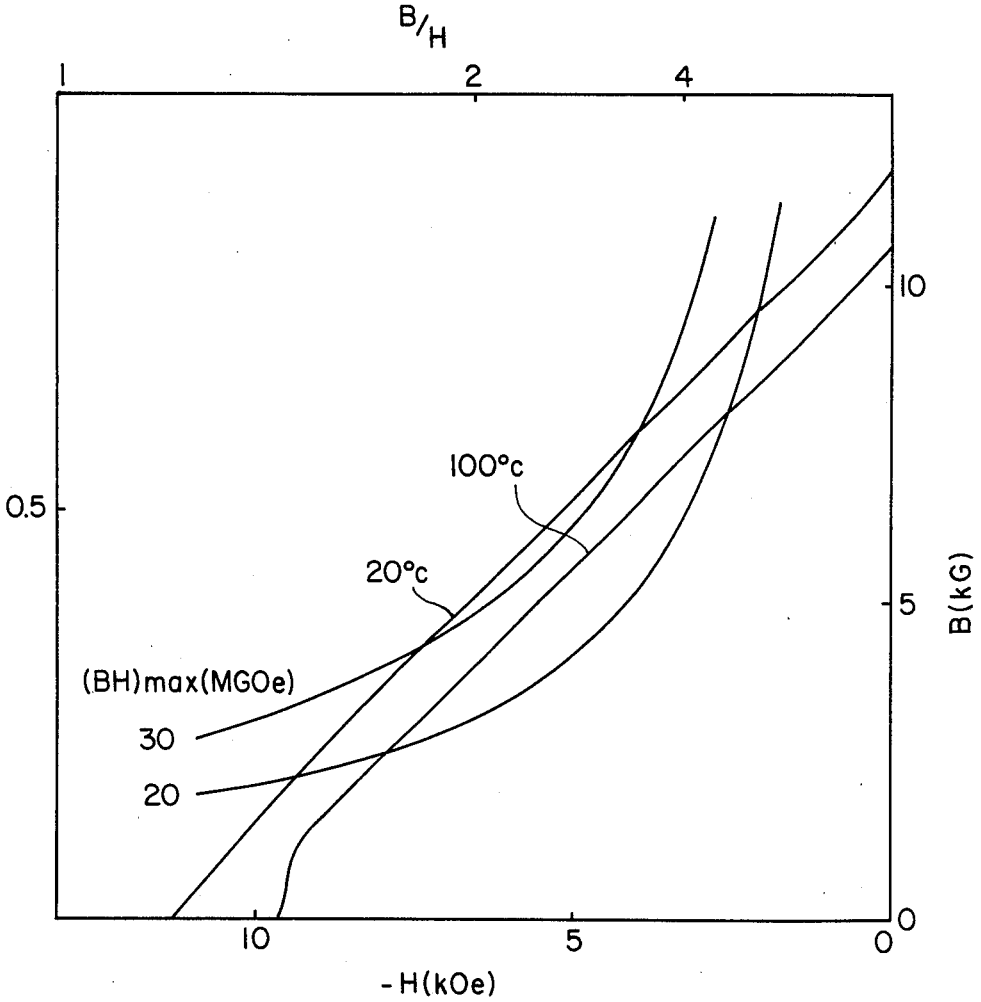
FIG. 4 is a graph showing the B-H demagnetization curves of the magnets according to the present invention with the permeance coefficient.

FIG. 4 shows the B-H demagnetization curves at 20° C. and 100° C. of Fe-8B-13.5Nd-1.5Dy (No. 7 in Table 2) obtained according to the present invention.

Compared with the demagnetization curve of the 30 MGOe-grade rare earth-cobalt magnet of FIG. 1, the B-H curves of the invented alloy of FIG. 4 are extending almost linearly in the secondary quadrant even at 100° C. This indicates that the invented alloy is more stable at both 20° C. and 100° C. against extraneous demagnetizing fields, etc. that the rare earth-cobalt magnet of FIG. 1 whose B-H curve bends in the vicinity of a permeance coefficient (B/H) of 1.

Figure 5:
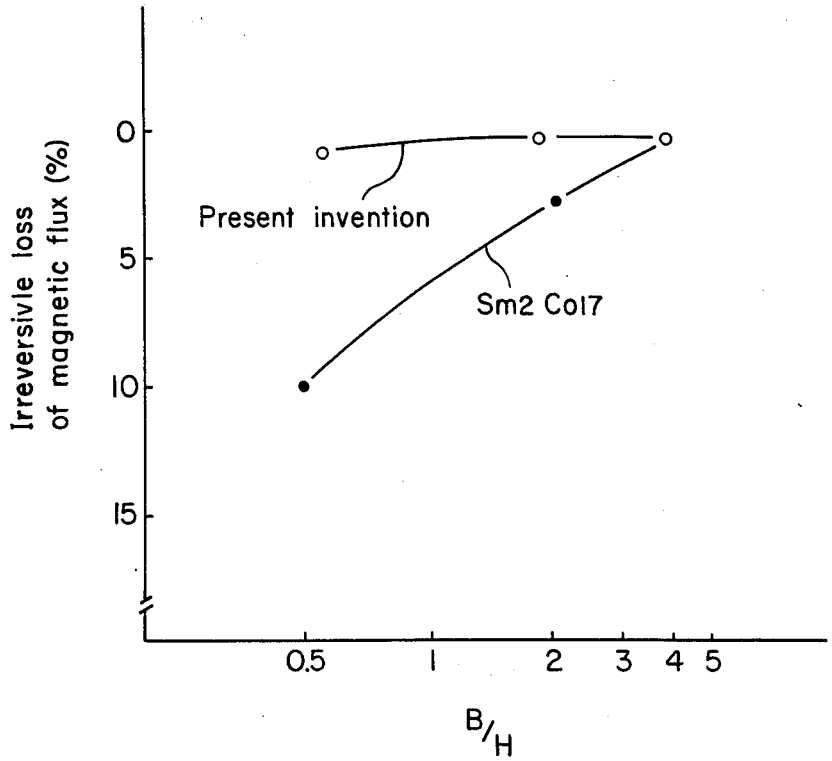
FIG. 5 is a graph showing the demagnetizing factor of the present magnet and the $Sm_2Co_{17}$ type magnet upon exposure to the atmosphere of 100° C.×1 hr and cooling down to room temperature (the abscissa—permeance coefficient B/H, logarithmic scale).

To substantially compare two types of magnets with each other in respect of stability, prepared were samples with the permeance coefficient being about 0.5, 2 and 4, which were in turn subjected to atmospheric exposure testing at 100° C. for one hour after magnetization and cooled down to room temperature to measure their irreversible loss magnetic flux. FIG. 5 shows the results, from which it has been found that the invented magnets are more stable than the prior art magnets.

Observation of demagnetization of magnets upon exposure to high temperatures is generally known as one method for acceleration testing of stability at room temperature (changes with time). From the results, the magnets according to the present invention are expected to possess sufficient stability at room temperature.

EXAMPLE 3

As the additional elements M use was made of Ti, Mo, Bi, Mn, Sb, Ni, Ta, Sn and Ge, each having a purity of 99%, W having a purity of 98%, Al having a purity of 99.9%, Hf having a purity of 95%, ferrovandium (serving as V) containing 81.2% of V, ferroniobium (serving as Nb) containing 67.6% of Nb, ferrochromium (serving as Cr) containing 61.9% of Cr and ferrozirconium (serving as Zr) containing 75.5% of Zr, wherein the purity is given by weight percent.

The starting materials were alloyed and sintered in accordance with the foregoing procedures, followed by aging at 500°-700° C. The results are shown in Table 3.

It has been ascertained that the FeBRM base alloys prepared by adding the additional elements M to the FeBR base systems have also sufficiently high iHc. For example, compare Nos. 15, 18 and 13 with Nos. 29, 30 and 31 respectively, in Table 3.

TABLE 1

| No. | alloy composition (at %) | iHc (kOe) | Br (KG) | (BH) max (MGOe) |
|---|---|---|---|---|
| *1 | Fe—8B—15Nd | 7.3 | 12.1 | 32.1 |
| *2 | Fe—8B—14Nd—2Y | 8.8 | 11.9 | 31.8 |
| *3 | Fe—8B—10.5Nd—4.5Ce | 5.7 | 10.7 | 22.4 |
| *4 | Fe—8B—10 5Nd—4.5Pr | 8.9 | 11.4 | 26.9 |
| *5 | Fe—8B—14Nd—1Sm | 5.4 | 12.3 | 27.0 |
| 6 | Fe—8B—10.5Nd—4.5Yb | 10.4 | 11.7 | 27.4 |
| 7 | Fe—8B—10.5Nd—4.5Er | 9.8 | 10.6 | 25.8 |
| 8 | Fe—8B—10.5Nd—4.5Gd | 11.4 | 10.3 | 25.0 |
| 9 | Fe—8B—10.5Nd—4.5Ho | 14.3 | 10.1 | 23.9 |

N.B.: *refers to reference tests

TABLE 2

| No. | alloy composition (at %) | iHc (kOe) | Br (kG) | (BH) max (MGOe) |
|---|---|---|---|---|
| *1 | Fe—8B—15Nd | 11.4 | 12.3 | 34.0 |
| 2 | Fe—8B—14.9Nd—0.1Dy | 11.8 | 12.4 | 35.0 |
| 3 | Fe—8B—14.8Nd—0.2Dy | 12.0 | 12.6 | 36.2 |
| 4 | Fe—8B—14.6Nd—0.4Dy | 12.8 | 12.7 | 38.0 |
| 5 | Fe—8B—14.2Nd—0.8Dy | 16.1 | 12.0 | 34.2 |
| 6 | Fe—8B—13.8Nd—1.2Dy | 18.0 | 11.5 | 31.3 |
| 7 | Fe—8B—13.5Nd—1.5Dy | 18.6 | 11.7 | 31.5 |
| 8 | Fe—8B—12Nd—3Dy | >20 | 11.4 | 30.3 |
| 9 | Fe—8B—13.5Nd—1.5Ho | 13.8 | 11.95 | 33.8 |
| 10 | Fe—8B—13.5Nd—1.5Gd | 13.8 | 11.75 | 32.1 |
| 11 | Fe—8B—13.5Nd—1.5Tb | 18.3 | 11.3 | 33.2 |
| 12 | Fe—8B—13.5Nd—1.5Er | 14.8 | 11.5 | 31.0 |
| 13 | Fe—8B—13.5Nd—1.5Yb | 13.1 | 12.3 | 35.0 |
| 14 | Fe—6B—6Nd—7Pr—1.5Dy | 16.3 | 11.2 | 25.2 |
| 15 | Fe—10B—13Pr—1.5Dy | 17.6 | 10.9 | 26.1 |
| 16 | Fe—10B—10Nd—3Ce—2Dy | 11.8 | 10.2 | 24.3 |
| 17 | Fe—10B—11Nd—2La—1Dy—1Gd | 14.2 | 10.7 | 25.5 |
| *18 | Fe—3.5B—15Nd—3Dy | 5.6 | 9.2 | 18.5 |
| *19 | Fe—10B—9.5Nd—2Dy | <5 | <5 | <5 |
| *20 | Fe—10B—30Nd—1.5Dy | 13.0 | <5 | <5 |
| *21 | Fe—30B—15Nd—2Dy | 12.2 | <5 | <5 |

TABLE 3

| No. | alloy composition (at %) | iHc (kOe) | Br (kG) | (BH) max (MGOe) |
|---|---|---|---|---|
| 1 | Fe—8B—13.5Nd—1.5Dy | 18.6 | 11.7 | 31.6 |
| 2 | Fe—8B—13.5Nd—1.5Dy—1Ti | 17.2 | 11.8 | 32.1 |
| 3 | Fe—8B—13.5Nd—1.5Dy—1Zr | 13.9 | 11.6 | 31.8 |
| 4 | Fe—8B—13.5Nd—1.5Dy—1Hf | 13.0 | 11.9 | 30.0 |
| 5 | Fe—8B—13.5Nd—1.5Dy—1Cr | 17.8 | 11.2 | 29.5 |
| 6 | Fe—8B—13.5Nd—1.5Dy—1Mn | 17.6 | 11.1 | 28.6 |
| 7 | Fe—8B—13.5Nd—1.5Dy—1Ni | 12.4 | 11.3 | 30.0 |
| 8 | Fe—8B—13.5Nd—1.5Dy—1Ta | 18.6 | 11.6 | 31.4 |
| 9 | Fe—8B—13.5Nd—1.5Dy—1Ge | 15.6 | 11.3 | 29.7 |
| 10 | Fe—8B—13.5Nd—1.5Dy—1Sn | 12.8 | 10.7 | 26.7 |
| 11 | Fe—8B—13.5Nd—1.5Dy—1Sb | 17.3 | 9.6 | 21.5 |
| 12 | Fe—8B—13.5Nd—1.5Dy—1Bi | 12.8 | 11.6 | 31.2 |
| 13 | Fe—8B—13.5Nd—1.5Dy—1Mo | 17.6 | 11.5 | 30.7 |
| 14 | Fe—8B—13.5Nd—1.5Dy—1Nb | 20 | 11.8 | 32.3 |
| 15 | Fe—8B—13.5Nd—1.5Dy—1Al | 19.4 | 11.6 | 31.4 |
| 16 | Fe—8B—13.5Nd—1.5Dy—1V | 18.7 | 11.5 | 31.0 |
| 17 | Fe—8B—13.5Nd—1.5Dy—1W | 19.0 | 11.4 | 30.6 |
| 18 | Fe—8B—12.5Nd—1.5Dy—1Nb | 17.4 | 11.9 | 33.0 |
| 19 | Fe—7B—13.5Nd—0.4Dy—1Nb | 12.8 | 12.8 | 38.4 |
| 20 | Fe—7B—12.5Nd—1.5Dy—1Nb | 16.9 | 12.3 | 35.4 |
| 21 | Fe—8B—11.5Nd—1.5Dy—1Nb | 16.3 | 12.2 | 34.8 |
| 22 | Fe—7B—13.5Nd—1.5Dy—1Al | 20 | 11.2 | 30.2 |
| 23 | Fe—7B—14.5Nd—1.5Dy—1Nb | 20 | 11.3 | 30.8 |
| 24 | Fe—7B—13.5Nd—1.5Dy—1V | 17.9 | 11.65 | 32.4 |
| 25 | Fe—8B—13.5Nd—1.5Dy—1W | 18.8 | 11.45 | 31.4 |
| 26 | Fe—7B—16.2Nd—0.8Dy—1Nb | 17.2 | 11.0 | 28.6 |

TABLE 3-continued

| No. | alloy composition (at %) | iHc (kOe) | Br (kG) | (BH) max (MGOe) |
|---|---|---|---|---|
| 27 | Fe—8B—13.5Nd—1.5Dy—1Si** | 13.6 | 11.5 | 30.8 |
| 28 | Fe—8B—13.5Nd—1.5Dy—1S** | 14.0 | 12.1 | 34.2 |
| *29 | Fe—8B—15Nd—1Al | 11.8 | 11.7 | 31.2 |
| *30 | Fe—8B—15Nd—1Nb | 12.2 | 11.9 | 32.7 |
| *31 | Fe—8B—15Nd—1Mo | 12.0 | 11.9 | 33.8 |

NB: **refers to other elements than M

TABLE 4

| | room temperature (22° C.) | | 100° C. | |
|---|---|---|---|---|
| | iHc (kOe) | (BH) max (MGOe) | iHc (kOe) | (BH) max (MGOe) |
| R—Co(2-17 type) magnet | 6.2 | 29.3 | 5.2 | 26.4 |
| Fe—8B—15Nd | 11.4 | 34.0 | 5.6 | 26.8 |
| Fe—8B—13.5Nd—1.5Dy | 18.6 | 31.5 | 9.8 | 27.0 |

We claim:

1. A magnetically anisotropic sintered permanent magnet of the FeBR system in which R represents the sum of $R_1$ and $R_2$ wherein:

$R_1$ is at least one rare earth element selected from the group consisting of Dy, Tb, Gd and Ho, and at least 80 at % of $R_2$ consists of Nd and/or Pr, the balance being at least one other element selected from the group consisting of La, Ce and Y, said system consisting essentially of, by atomic percent, 0.2 to 5% of $R_1$, 12.5 to 20% of R, 4 to 20% of B, and the balance being at least 60% Fe;

said magnet having a tetragonal Fe-B-R crystal structure phase of at least 50 vol % of the entire magnet, and having a maximum energy product of at least 25 MGOe and an intrinsic coercive force of at least 13 kOe.

2. A magnetically anisotropic sintered permanent magnet of the FeBRM system in which R represents the sum of $R_1$ and $R_2$ wherein:

$R_1$ is at least one rare earth element selected from the group consisting of Dy, Tb, Gd and Ho, at least 80 at % of $R_2$ consists of Nd and/or Pr, the balance being at least one other element selected from the group consisting of La, Ce and Y, and M represents additional elements M as specified hereinbelow, said system consisting essentially of, by atomic percent, 0.2 to 5% of $R_1$, 12.5 to 20% of R, 4 to 20% of B, at least one of the additional elements M in the amount of no more than the atomic percentages as specified hereinbelow, and the balance being at least 60% Fe:

M being:

| | | |
|---|---|---|
| 3% Ti, | 3.3% Zr, | 3.3% Hf, |
| 4.5% Cr, | 5% Mn, | 6% Ni, |
| 7% Ta, | 3.5% Ge, | 1.5% Sn, |
| 1% Sb, | 5% Bi, | 5.2% Mo, |
| 9% Nb, | 5% Al, | 5.5% V, and |
| 5% W, | | |

provided that, when two or more additional elements M are included, the sum of M is no more than the maximum atomic percentage among those specified above of said elements M actually added, said magnet having a tetragonal Fe-B-R crystal structure phase of at least 50 vol % of the entire magnet, and having a maximum energy product of at least 25 MGOe and an intrinsic coercive force of at least 13 kOe.

3. A permanent magnet as defined in claim 1 or 2, wherein by atomic percent, $R_1$ is 0.2–3%, R is 13–19%, and B is 5–11%.

4. A permanent magnet as defined in claim 1 or 2, wherein $R_1$ comprises at least one of Dy and Tb.

5. A permanent as defined in claim 1 or 2, wherein $R_1$ is Dy.

6. A permanent magnet as defined in claim 1 or 2, wherein $R_1$ is about 0.4 atomic percent.

7. A permanent magnet as defined in claim 1 or 2, wherein $R_1$ is about 1.5 atomic percent.

8. A permanent magnet as defined in claim 2, wherein the additional elements M comprises one or more selected from the group consisting of V, Nb, Ta, Mo, W, Cr and Al.

9. A permanent magnet as defined in claim 8, wherein M is no more than about 2 atomic percent.

10. A permanent magnet as defined in claim 1 or 2, which has been sintered at a temperature between 900° and 1200° C.

11. A permanent magnet as defined in claim 3, which has a maximum energy product of at least 30 MGOe.

12. A permanent magnet as defined in claim 11, which has a maximum energy product of at least 33 MGOe.

13. A permanent magnet as defined in claim 6, which has a maximum energy product of at least 33 MGOe.

14. A permanent magnet as defined in claim 13, which has a maximum energy product of at least 35 MGOe.

15. A permanent magnet as defined in claim 1 or 2, which has an intrinsic coercivity of at least 15 kOe.

16. A permanent magnet as defined in claim 15, which has an intrinsic coercivity of at least 17 kOe.

17. A permanent magnet as defined in claim 7, which has an intrinsic coercivity of at least 15 kOe.

18. A permanent magnet as defined in claim 17, which has an intrinsic coercivity of at least 17 kOe.

19. A permanent magnet as defined in claim 1 or 2, wherein $R_2$ is at least one of Nd and Pr.

20. A permanent magnet as defined in claim 1 or claim 2, which has been subjected to aging after sintering at a temperature between 350° C. and 900° C.

21. A permanent magnet as defined in claim 20, which has been subjected to aging at a temperature of no higher than 800° C.

22. A permanent magnet as defined in claim 20, which has been subjected to aging at a temperature of at least 450°.

23. A permanent magnet as defined in claim 1 or 2, wherein $R_1$ is Tb.

24. A permanent magnet as defined in claim 1 or 2, wherein $R_1$ is Ho.

25. A permanent magnet as defined in claim 1 or 2, which is substantially Co-free.

26. A permanent magnet as defined in claim 1 or 2, wherein $R_2$ is Nd.

* * * * *